US006804915B2

(12) United States Patent
Holmqvist

(10) Patent No.: US 6,804,915 B2
(45) Date of Patent: Oct. 19, 2004

(54) DOOR GASKET AT A REFRIGERATOR OR FREEZER

(75) Inventor: Rolf Holmqvist, Skövde (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 10/163,924

(22) Filed: Jun. 6, 2002

(65) Prior Publication Data

US 2003/0019159 A1 Jan. 30, 2003

(30) Foreign Application Priority Data

Jun. 14, 2001 (SE) ..... 0102121

(51) Int. Cl.[7] ..... E06B 7/16
(52) U.S. Cl. ..... 49/492.1; 49/490.1
(58) Field of Search ..... 49/478.1, 492.1, 49/490.1, 489.1, 477.1, 495.1, 498.1; 312/296, 405

(56) References Cited

U.S. PATENT DOCUMENTS

| | | | | | |
|---|---|---|---|---|---|
| 3,126,590 | A | * | 3/1964 | Monti | 49/478.1 |
| 3,289,352 | A | * | 12/1966 | Heilweil et al. | 49/478.1 |
| 3,323,256 | A | * | 6/1967 | Reahard et al. | 49/478.1 |
| 3,378,957 | A | * | 4/1968 | Frehse | 49/478.1 |
| 6,464,312 | B1 | * | 10/2002 | Tenhundfeld et al. | 49/478.1 |

FOREIGN PATENT DOCUMENTS

DE 35 25 538 A1 7/1985

* cited by examiner

*Primary Examiner*—Hugh B. Thompson, II
(74) *Attorney, Agent, or Firm*—Pearne & Gordon LLP

(57) ABSTRACT

A door gasket at a refrigerator freezer is kept in place by an elastic part (32) of the gasket with two legs holding around a waist (35) of a ridge-shaped element (34), which part (32) in profile substantially has the shape of an arc of a circle extending over about 270°.

3 Claims, 1 Drawing Sheet

DOOR GASKET AT A REFRIGERATOR OR FREEZER

FIELD OF THE INVENTION

The invention refers to a door gasket at a refrigerator or freezer comprising a housing closable by a door; the gasket, which is located in a gap between the door and the housing at the periphery of the door, being kept in place by an elastic part of the gasket with two legs holding around a waist of a ridge-shaped element.

BACKGROUND OF THE INVENTION

Such a gasket, which .is easy to fix on and remove from the ridge-shaped element, is known through DE 35 25 538 A1. At this known gasket the elastic part is constituted by an arched central part, which at its respective ends in sharp bends goes over into legs directed towards each other. When the legs shall be pressed on to the ridge-shaped element, tension concentrations will occur in said bends, which limits the flexibility of the elastic part and by that makes demands upon dimensional accuracy of the outer width of the ridge-shaped element.

BRIEF SUMMARY OF THE INVENTION

The object of the invention is to improve the flexibility of the elastic part so that a greater variation of the outer width of the ridge-shaped element can be allowed, which has a great importance when the ridge-shaped element for instance is constituted by a part of a vacuum shaped plastic sheet.

This object is reached by the door gasket according to the invention thereby that the elastic part in profile substantially has the shape of an arc of a circle extending over more than 180°.

By this the tensions will be distributed substantially evenly over whole the elastic part, which gives the desired improvement of its flexibility.

BRIEF DESCRIPTION OF THE SEVERAL VIEWS OF THE DRAWINGS

An embodiment of a gasket according to the invention is described below in connection with the enclosed drawing, in which.

DETAILED DESCRIPTION OF THE INVENTION

Figure 1:
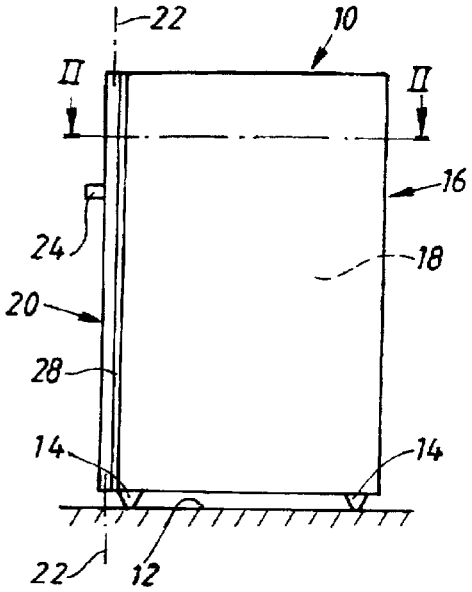
FIG. 1 shows a side view of a refrigerator and FIG. 2 shows an enlargement of a part of a section according to the marking II—II in FIG. 1

By 10 is designated a refrigerator, which stands on a ground 12 by feet 14. The refrigerator includes a heat insulating housing 16 enclosing a chamber 18, which is cooled by a not shown refrigerating apparatus. The chamber is closable by a heat insulating door 20, which is turnable around a vertical axis 22 by means of a handle 24.

When the door 20 is closed the chamber 18 is sealed by a gasket 26, which is located in a gap 28 between the periphery of the door and the housing 16. The gasket 26 is constituted by two parts, viz. one sealing part 30 of a softer elastic plastic material and a holder part 32, which is fixedly connected with the sealing part 30, of a stiffer elastic plastic material. The holder part 32, which in profile substantially has the shape of an arc of a circle extending over about 270°, is mounted on the door 20 by it being pressed over a ridge-shaped element 34 of the door, so that the legs of the holder part 32 will hold around a waist 35 of the ridge-shaped element.

Figure 2:
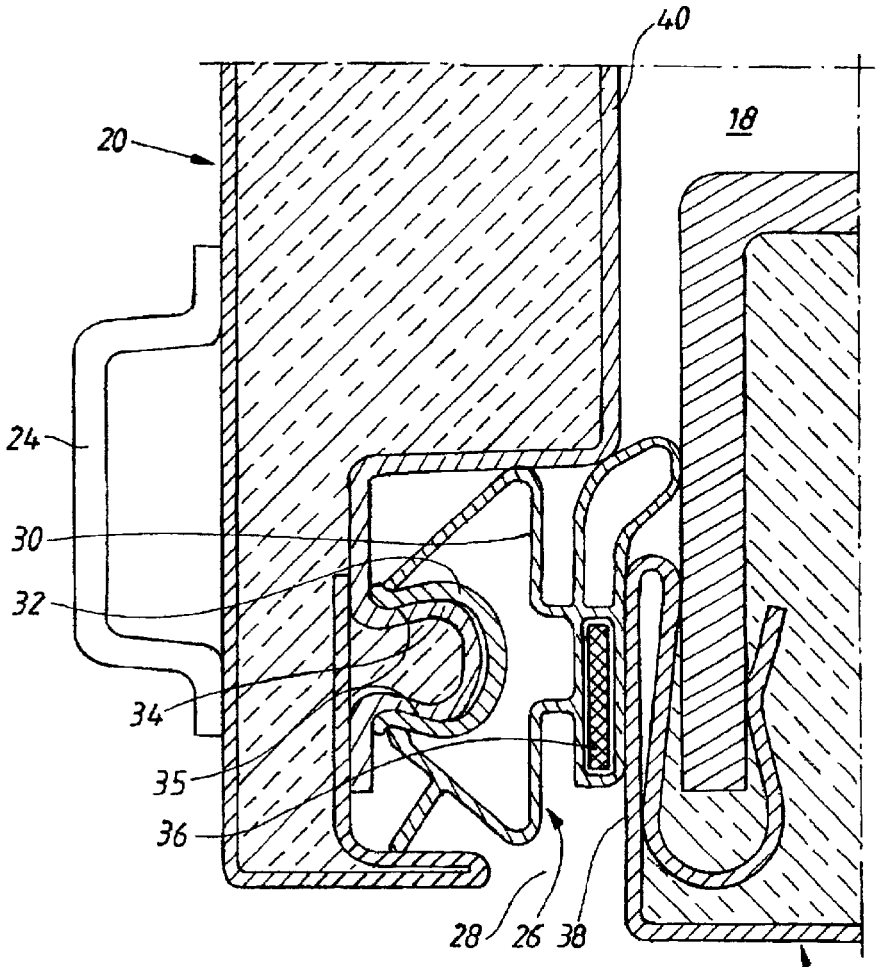

The gasket is for instance made through extrusion in one and the same piece of as well the sealing part 30 as the holder part 32. The sealing part 30 can be designed in different ways in order that it in the best way shall keep the gap 28 closed when the door 20 is closed, and prevent conduction of heat through the gap 28. The sealing part 30 can for instance have a space for a magnetic strip 36, which when the door 20 is closed in a way known in the context helps to keep the sealing part 30 pressed against a surface 38 of iron of the housing 16. Although the sealing part 30 in FIG. 2 is shown to be connected with the holder part 32 at the ends of its respective legs, also other places of connection between the sealing part 30 and the holder part 32 can be imagined.

The ridge-shaped element 34, the outside of which in profile substantially has the shape of an arc of a circle extending over about 270°, can constitute part of a vacuum shaped plastic sheet, which furthermore forms inside 40 of the door 20.

The refrigerator or freezer according to the invention also includes such refrigerators or freezers which have a horizontal access opening, for instance chest freezers, the door being in a horizontal position, when it is closed.

What is claimed is:

1. A system comprising: a door gasket for a refrigerator or freezer, the refrigerator or freezer comprising a housing (16) and a door (20) having a flange (34), the door gasket (26) being kept in place in a gap (28) between the door and the housing at the periphery of the door by an elastic part (32) of the gasket, the elastic part comprising two legs that matingly engage a narrowed waist portion (35) of the flange (34) so as to retain the gasket thereon, wherein a cross-section of the elastic part (32) substantially has the shape of an arc of a circle extending over more than 180°.

2. The system according to claim 1, wherein an outside of the cross-section of the flange (34) substantially has the shape of an arc of a circle extending over more than 180°.

3. The system according to claim 1 or 2, wherein the arc of the circle extends over about 270°.

* * * * *